US007570108B2

(12) United States Patent
Morgan et al.

(10) Patent No.: US 7,570,108 B2
(45) Date of Patent: Aug. 4, 2009

(54) APPARATUS FOR REGULATING VOLTAGE

(75) Inventors: Mark W. Morgan, Allen, TX (US); Yanli Fan, Allen, TX (US); Hector Torres, McKinney, TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/695,604

(22) Filed: Oct. 28, 2003

(65) Prior Publication Data

US 2005/0088223 A1 Apr. 28, 2005

(51) Int. Cl.
*G06G 7/12* (2006.01)
*G06G 7/26* (2006.01)

(52) U.S. Cl. ..... 327/563; 327/540; 327/513

(58) Field of Classification Search ..... 327/538–541, 327/543, 512, 513, 560–563; 323/280, 316
See application file for complete search history.

(56) References Cited

U.S. PATENT DOCUMENTS 4,064,506 A * 12/1977 Cartwright, Jr. ..... 341/135
5,434,533 A * 7/1995 Furutani ..... 327/538
6,020,781 A * 2/2000 Fujioka ..... 327/541
6,512,412 B2 * 1/2003 Casper ..... 327/538
6,566,852 B2 * 5/2003 Tagami et al. ..... 323/316

* cited by examiner

*Primary Examiner*—Quan Tra
(74) *Attorney, Agent, or Firm*—John J. Patti; Wade J. Brady, III; Frederick J. Telecky, Jr.

(57) ABSTRACT

An apparatus for regulating voltage for at least one differential transistor pair having a voltage follower buffer, the voltage follower section having a first voltage-temperature response, includes: (a) a differential amplifier having two input loci and an output locus, a first input locus of the two input loci receiving a reference voltage; (b) a temperature responsive unit coupled between the output locus and ground; and (c) a feedback line coupled between the temperature responsive unit and a second input locus of the two input loci. The temperature responsive unit has a second voltage-temperature response similar to the first voltage-temperature response.

3 Claims, 3 Drawing Sheets

APPARATUS FOR REGULATING VOLTAGE

BACKGROUND OF THE INVENTION

The present invention is directed to differential signaling devices, and especially to multi-stage differential signaling output devices. The present invention is particularly useful with low voltage multi-stage differential signaling output devices.

Apparatuses designed to perform as interface drivers for use with LVDS (low voltage differential signaling) output stages require precise common mode control for the output signal. Such LVDS output stage devices are often embodied in multi-stage configurations involving multiple differential transistor pairs in a serial cascaded arrangement. Each differential transistor pair has level shifter or follower transistors used to adjust the common mode for a succeeding stage. To regulate the common mode of the final output stage, a sample of the output signal is provided to an error amplifier, and compared with a reference voltage to generate a feedback signal to effect the required feedback control. Such an arrangement provides compensation for temperature variation. As the base-to-emitter voltage ($V_{be}$) of the follower transistors varies over temperature, that change affects the sample of the output signal provided to the error amplifier that provides the feedback signal for regulating the common mode of the final output stage.

The prior art topology described above for regulating voltages in differential signaling output devices has been useful in prior art devices, but is problematic in low voltage output devices. In low voltage differential signaling output devices all stages previous to the output stage require some common mode regulation to prevent saturating the differential transistor pair in the output stage. Prior art differential signaling output devices provide a regulator circuit for each stage preceding the final output stage to regulate the common mode for each stage and avoid saturating the differential transistor pair in the next succeeding stage. Simply reducing each interstage supply voltage provided t a succeeding stage using a resistor ignores the effects of variations in temperature and variations in supply voltage.

Providing a substantially duplicate regulator circuit for each stage requires relatively large sampling resistors that generate heat and require significant areas of silicon to implement. However, simply eliminating interstage sense resistors and regulating interstage supplies to a fixed voltage results in large variations in common mode voltage as temperature varies because no $V_{be}$ temperature compensation is provided.

There is a need for an apparatus for regulating voltage for at least one differential transistor pair having a voltage follower buffer exhibiting a voltage-temperature response.

There is a need for an apparatus for providing a regulated voltage signal to selected stages of a multi-stage differential signaling device, the selected stages each having a voltage follower buffer exhibiting a voltage-temperature response.

SUMMARY OF THE INVENTION

An apparatus for regulating voltage for at least one differential transistor pair having a voltage follower buffer, the voltage follower section having a first voltage-temperature response, includes: (a) a differential amplifier having two input loci and an output locus, a first input locus of the two input loci receiving a reference voltage; (b) a temperature responsive unit coupled between the output locus and ground; and (c) a feedback line coupled between the temperature responsive unit and a second input locus of the two input loci.

The temperature responsive unit has a second voltage-temperature response similar to the first voltage-temperature response.

It is, therefore, an object of the present invention to provide an apparatus for regulating voltage for at least one differential transistor pair having a voltage follower buffer exhibiting a voltage-temperature response.

It is a further object of the present invention to provide an apparatus for providing a regulated voltage signal to selected stages of a multi-stage differential signaling device, the selected stages each having a voltage follower buffer exhibiting a voltage-temperature response.

Further objects and features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
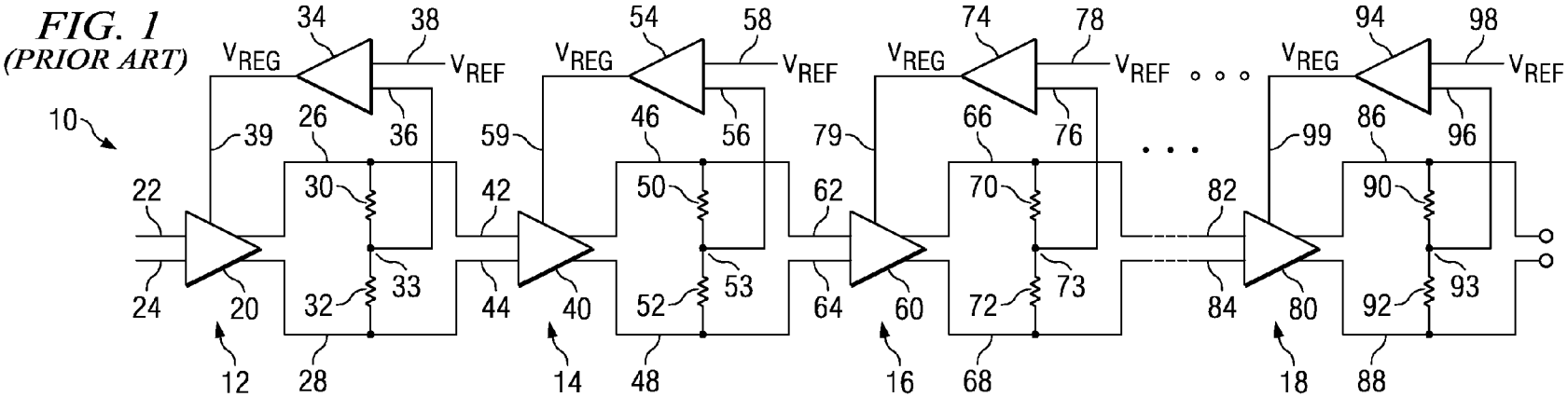
FIG. 1 (PRIOR ART)
FIG. 1 is a simplified electrical schematic diagram illustrating a prior art multi-stage differential signaling device.

FIG. 1 is a simplified electrical schematic diagram illustrating a prior art multi-stage differential signaling device. In FIG. 1, a differential signaling output device 10 includes a first stage 12, a second stage 14, a third stage 16 and an nth stage 18. The indicator "n" is employed to signify that there can be any number of stages in security differential signaling output device 10. The inclusion of four stages 12, 14, 16, 18 in FIG. 1 is illustrative only.

First stage 12 includes a differential amplifier 20 receiving input signals at input loci 22, 24 and presenting output signals at output loci 26, 28. Sampling resistors 30, 32 are coupled in series between output loci 26, 28. Sampling resistors 30, 32 are usually substantially equal in value. An error amplifier 34 has input loci 36, 38 and an output line 39. First input locus 36 is coupled with sampling locus 33. A reference voltage $V_{REF}$ is applied to second input locus 38. A regulating voltage $V_{REG}$ is provided to differential amplifier 20 via output line 39.

Second stage 14 includes a differential amplifier 40 receiving input signals at input loci 42, 44 and presenting output signals at output loci 46, 48. Sampling resistors 50, 52 are coupled in series between output loci 46, 48. Sampling resistors 50, 52 are usually substantially equal in value. An error amplifier 54 has input loci 56, 58 and an output line 59. First input locus 56 is coupled with sampling locus 53. A reference voltage $V_{REF}$ is applied to second input locus 58. A regulating voltage $V_{REG}$ is provided to differential amplifier 40 via output line 59. Input loci 42, 44 are coupled to receive signals from output loci 26, 28 of differential amplifier 20.

Third stage 16 includes a differential amplifier 60 receiving input signals at input loci 62, 64 and presenting output signals at output loci 66, 68. Sampling resistors 70, 72 are coupled in series between output loci 66, 68. Sampling resistors 70, 72 are usually substantially equal in value. An error amplifier 74 has input loci 76, 78 and an output line 79. First input locus 76 is coupled with sampling locus 73. A reference voltage $V_{REF}$ is applied to second input locus 78. A regulating voltage $V_{REG}$ is provided to differential amplifier 60 via output line 79. Input loci 62, 64 are coupled to receive signals from output loci 46, 48 of differential amplifier 40.

Nth stage 18 includes a differential amplifier 80 receiving input signals at input loci 82, 84 and presenting output signals at output loci 86, 88. Sampling resistors 90, 92 are coupled in series between output loci 86, 88. Sampling resistors 90, 92 are usually substantially equal in value. An error amplifier 94 has input loci 96, 98 and an output line 99. First input locus 96 is coupled with sampling locus 93. A reference voltage $V_{REF}$ is applied to second input locus 98. A regulating voltage $V_{REG}$ is provided to differential amplifier 80 via output line 99. Input loci 82, 84 are coupled to receive signals from output loci from the next earlier adjacent differential amplifier in differential signaling output device 10, such as output loci 66, 68 of differential amplifier 60.

Figure 2:
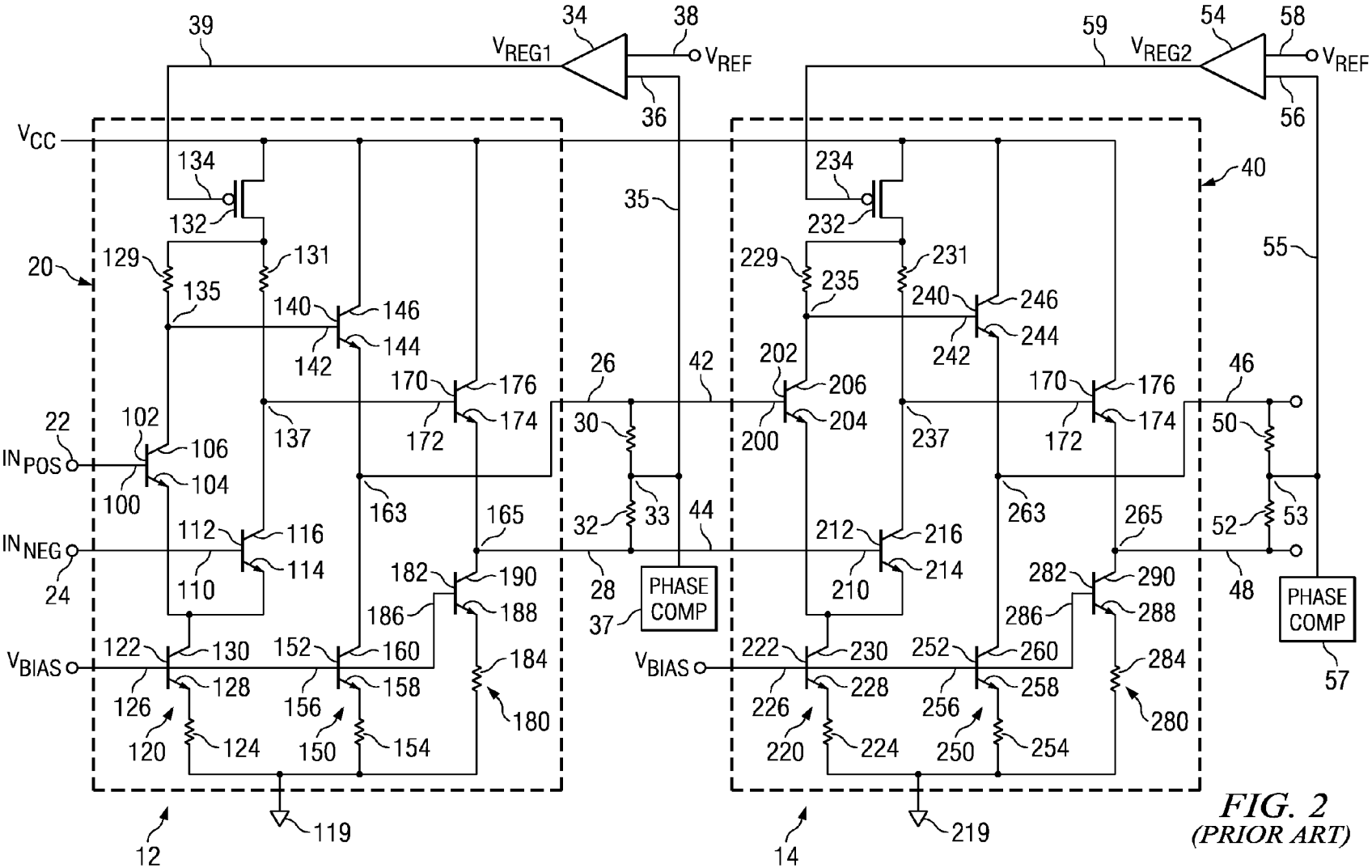
FIG. 2 (PRIOR ART)
FIG. 2 is an electrical schematic diagram showing details of two adjacent stages of the differential signaling device illustrated in FIG. 1.

FIG. 2 is an electrical schematic diagram showing details of two adjacent stages of the differential signaling device illustrated in FIG. 1. In FIG. 2, first stage 12 and second stage 14 of differential signaling output device 10 (FIG. 1) are illustrated.

First stage 12 receives a positive input signal $IN_{POS}$ at input locus 22 and receives a negative input signal $IN_{NEG}$ at input locus 24. Input locus 22 is coupled with a base 100 of an NPN transistor 102. Transistor 102 has an emitter 104 and a collector 106. Input locus 24 is coupled with a base 110 of an NPN transistor 112. Transistor 112 has an emitter 114 and a collector 116. Emitters 104, 114 are coupled with ground 119 via a bias circuit 120. Bias circuit 120 includes an NPN transistor 122 and a resistor 124 coupled in series. Transistor 122 has a base 126, an emitter 128 and a collector 130. Collector 130 is coupled with emitters 104, 114. Emitter 128 is coupled with resistor 124. A bias voltage $V_{BIAS}$ is applied to base 126 to control conducting operation by transistor 122. Collectors 106, 116 are coupled with a PMOS transistor 132 via resistors 129, 131. Transistor 132 has a gate 134 that controls connection with a supply voltage $V_{CC}$.

A follower transistor 140 has a base 142, an emitter 144 and a collector 146. Base 142 is coupled with a connection locus 135 between collector 106 and resistor 129. Collector 146 is coupled with supply voltage $V_{CC}$. Emitter 144 is coupled with ground 119 via a bias circuit 150. Bias circuit 150 includes an NPN transistor 152 and a resistor 154 coupled in series. Transistor 152 has a base 156, an emitter 158 and a collector 160. Collector 160 is coupled with emitters 144. Emitter 158 is coupled with resistor 154. A bias voltage $V_{BIAS}$ is applied to base 156 to control conducting operation by transistor 152.

A follower transistor 170 has a base 172, an emitter 174 and a collector 176. Base 172 is coupled with a connection locus 137 between collector 116 and resistor 131. Collector 176 is coupled with supply voltage $V_{CC}$. Emitter 174 is coupled with ground 119 via a bias circuit 180. Bias circuit 180 includes an NPN transistor 182 and a resistor 184 coupled in series. Transistor 182 has a base 186, an emitter 188 and a collector 190. Collector 190 is coupled with emitter 174. Emitter 188 is coupled with resistor 184. A bias voltage $V_{BIAS}$ is applied to base 186 to control conducting operation by transistor 182.

Output locus 26 is coupled with a connection locus 163 between collector 160 and emitter 144. Output locus 28 is coupled with a connection locus 165 between collector 190 and emitter 174. Sampling resistors 30, 32 are coupled between output loci 26, 28. Error amplifier 34 is coupled by a first input locus 36 and a line 35 with sampling locus 33 and receives reference voltage $V_{REF}$ at a second input locus 38. Error amplifier 34 provides regulating voltage $V_{REG1}$ via line 39 to gate 134 of transistor 132. A phase compensation unit 37 is coupled with line 35 to effect appropriate phase adjustments for signals appearing on line 35.

Second stage 14 receives a first input signal from output locus 26 at input locus 42 and receives a second input signal from output locus 28 at input locus 44. Input locus 42 is coupled with a base 200 of an NPN transistor 202. Transistor 202 has an emitter 204 and a collector 206. Input locus 44 is coupled with a base 210 of an NPN transistor 212. Transistor 212 has an emitter 214 and a collector 216. Emitters 204, 214 are coupled with ground 219 via a bias circuit 220. Bias circuit 220 includes an NPN transistor 222 and a resistor 224 coupled in series. Transistor 222 has a base 226, an emitter 228 and a collector 230. Collector 230 is coupled with emitters 204, 214. Emitter 228 is coupled with resistor 224. A bias voltage $V_{BIAS}$ is applied to base 226 to control conducting operation by transistor 222. Collectors 206, 216 are coupled with a PMOS transistor 232 via resistors 229, 231. Transistor 232 has a gate 234 that controls connection with a supply voltage $V_{CC}$.

A follower transistor 240 has a base 242, an emitter 244 and a collector 246. Base 242 is coupled with a connection locus 235 between collector 206 and resistor 229. Collector 246 is coupled with supply voltage $V_{CC}$. Emitter 244 is coupled with ground 219 via a bias circuit 250. Bias circuit 250 includes an NPN transistor 252 and a resistor 254 coupled in series. Transistor 252 has a base 256, an emitter 258 and a collector 260. Collector 260 is coupled with emitter 244. Emitter 258 is coupled with resistor 254. A bias voltage $V_{BIAS}$ is applied to base 256 to control conducting operation by transistor 252.

A follower transistor 270 has a base 272, an emitter 274 and a collector 276. Base 272 is coupled with a connection locus 237 between collector 216 and resistor 231. Collector 276 is coupled with supply voltage $V_{CC}$. Emitter 274 is coupled with ground 219 via a bias circuit 280. Bias circuit 280 includes an NPN transistor 282 and a resistor 284 coupled in series. Transistor 282 has a base 286, an emitter 288 and a collector 290. Collector 290 is coupled with emitter 274. Emitter 288 is coupled with resistor 284. A bias voltage $V_{BIAS}$ is applied to base 286 to control conducting operation by transistor 282.

Output locus 46 is coupled with a connection locus 263 between collector 260 and emitter 244. Output locus 48 is coupled with a connection locus 265 between collector 290 and emitter 274. Sampling resistors 50, 52 are coupled between output loci 46, 48. Error amplifier 54 is coupled by a first input locus 56 and a line 55 with sampling locus 53 and receives reference voltage $V_{REF}$ at a second input locus 58. Error amplifier 54 provides regulating voltage $V_{REG2}$ via line 59 to gate 234 of transistor 232. A phase compensation unit 57 is coupled with line 55 to effect appropriate phase adjustments for signals appearing on line 55.

Regulating voltage $V_{REG1}$ on line 39 is selected to gate transistor 132 to ensure that transistors 102, 112 are not reverse-biased, that is to ensure that base-to-emitter voltage $V_{be}$ is positive for transistors 102, 112. Regulating voltage $V_{REG1}$ is further established to ensure an appropriate common mode signal is provided from first stage 12 at output loci 26, 28 to input loci 42, 44 of stage 14. Similarly, regulating voltage $V_{REG2}$ on line 59 is selected to gate transistor 232 to ensure that transistors 202, 212 are not reverse-biased, that is to ensure that base-to-emitter voltage $V_{be}$ is positive for transistors 202, 212. Regulating voltage $V_{REG2}$ is further established to ensure an appropriate common mode signal is provided from second stage 14 at output loci 46, 48 to input loci of a later stage (e.g., stage 16; FIG. 1).

As temperature varies, the base-to-emitter voltage $V_{be}$ of each of follower transistors 140, 170, 240, 270 changes. That change is sensed by sampling between common mode resistors 30, 32 and between common mode resistors 50, 52 and accounted for by error amplifiers 34, 54. Thus, first stage 12 and second stage 14 are provided temperature compensation during changes in temperature while operating.

As mentioned earlier herein, in low voltage differential signaling output devices such as device 10 (FIG. 1) all stages 12, 14, 16 previous to the output stage 18 require some common mode regulation to prevent saturating the differential transistor pair in the output stage. Prior art differential signaling output devices provide a regulator circuit for each stage preceding the final output stage to regulate the common mode for each stage and avoid saturating the differential transistor pair in the next succeeding stage (e.g., transistors 202, 212 in second stage 14; FIG. 2). Simply reducing each interstage supply voltage provided to a succeeding stage using a resistor ignores the effects of variations in temperature and variations in supply voltage.

However, providing a substantially duplicate regulator circuit for each stage requires relatively large sampling resistors (e.g., resistors 30, 32 in first stage 12; FIG. 2) that generate heat and require significant areas of silicon to implement. Simply eliminating interstage sense resistors and regulating interstage supplies to a fixed voltage results in large variations in common mode voltage as temperature varies because no $V_{be}$ temperature compensation is provided.

Figure 3:
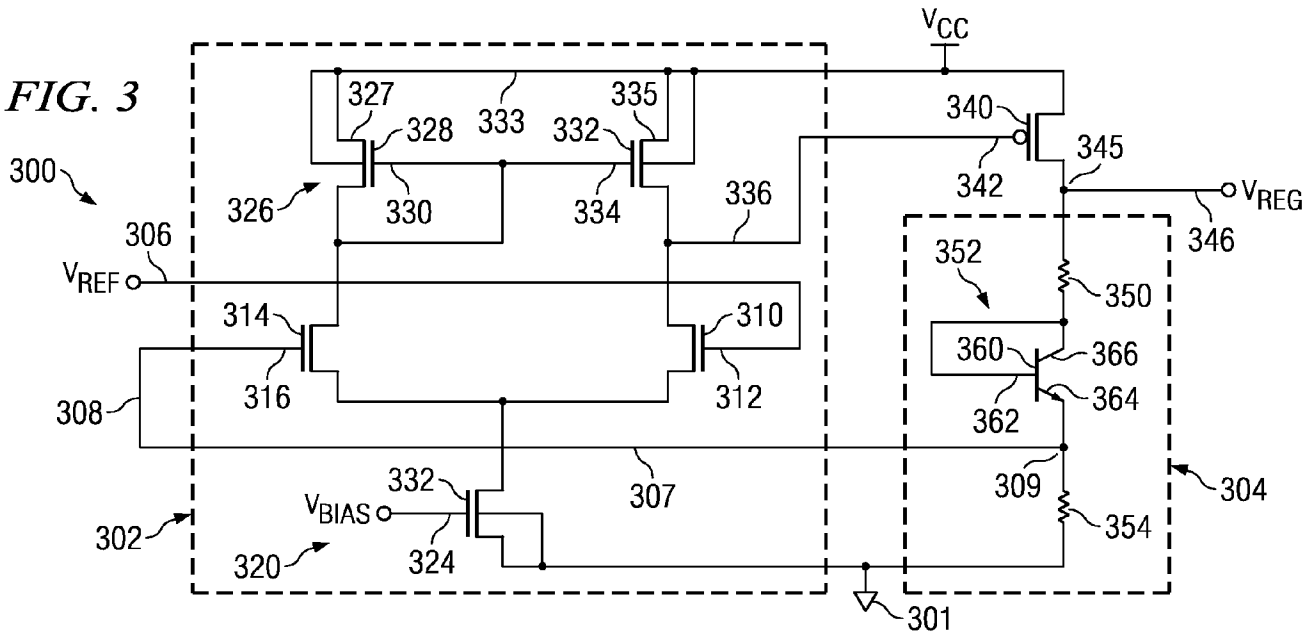
FIG. 3 is an electrical schematic diagram illustrating the preferred embodiment of the present invention.

FIG. 3 is an electrical schematic diagram illustrating the preferred embodiment of the present invention. In FIG. 3, a voltage regulator apparatus 300 includes a differential amplifier 302 and a temperature responsive unit 304. Differential amplifier 302 has a first input locus 306 and a second input locus 308. A reference voltage $V_{REF}$ is applied at first input locus 306. Second input locus 308 is coupled with temperature responsive unit 304 via feedback line 307.

Differential amplifier 302 includes an NMOS transistor 310 having a gate 312 coupled with first input locus 306, and an NMOS transistor 314 having a gate 316 coupled with second input locus 308. Transistors 310, 314 are coupled to ground 301. A gating signal $V_{BIAS}$ is applied to gate 324 to provide a bias voltage for transistor 322. When gating signal $V_{BIAS}$ is higher than threshold voltage of the transistor, transistor 322 conducts and provides a bias current for transistors 310, 314.

Transistors 310, 314 are also coupled with a current mirror 326. Current mirror 326 includes a PMOS transistor 328 having a gate 330 and a PMOS transistor 332 having a gate 334. Transistor 328 is diode-coupled between transistor 314 and a voltage supply line 333 providing a supply voltage signal $V_{CC}$. Transistor 332 is coupled between transistor 310 and voltage supply line 333. Gates 330, 334 are coupled together and with source 327 of transistor 328 and source 335 of transistor 332. Voltage supply line 333 is coupled with sources 327, 335. An amplifier output locus 336 provides an output signal from differential amplifier 302 to a gate 342 of a PMOS transistor 340. Transistor 340 is coupled between voltage supply line 333 and temperature responsive unit 304. Temperature responsive unit 304 is coupled between transistor 340 and ground 301. A regulated signal output locus 346 is coupled with a connection locus 345 and presents a regulated output signal $V_{REG}$ from voltage regulator apparatus 300.

Temperature responsive unit 304 includes at least one resistive element coupled in series with a temperature responsive element. The temperature responsive element is designed to model the voltage-temperature response of supplied voltage follower buffers or transistors (e.g., transistors 140, 170; FIG. 2) in a stage of a differential signaling output device such as a differential signaling output device (FIG. 7) to which regulated output signal $V_{REG}$ is supplied. In the preferred embodiment of temperature responsive unit 304 illustrated in FIG. 3, temperature responsive element 304 includes a first resistive element 350 coupled in series with transistor 340, a temperature responsive element 352 coupled in series with resistive element 350 and a second resistive element 354 coupled in series between temperature responsive element 352 and ground 301. Feedback line 307 is coupled at a connection locus 309 intermediate temperature responsive element 352 and resistive element 354.

Temperature responsive element 352 is preferably embodied in an NPN transistor 360 having a base 362, an emitter 364 and a collector 366. Collector 366 is coupled with resistive element 350. Emitter 364 is coupled with resistive element 354. Base 362 is diode-coupled with collector 364. Preferably transistor 360 exhibits a similar voltage-temperature response as is exhibited by supplied voltage follower transistors (e.g., transistors 140, 170; FIG. 2) in supplied differential output stages (e.g., stages 12, 14; FIG. 2) to which regulated output signal $V_{REG}$ is supplied. It is desired that the voltage-temperature response of temperature responsive unit 304 closely track or mirror the voltage-temperature response exhibited by supplied stages (e.g., stages 12, 14; FIG. 2). However, choices of various components in voltage regulator apparatus 300 may require somewhat different voltage levels be experienced by transistor 360 than are experienced by supplied follower transistors (e.g., transistors 140, 170; FIG. 2). The term modeling is employed herein to indicate that the profile of voltage-temperature response for transistor 360 and for supplied follower transistors is preferably substantially similar, but the voltage values may not necessarily be the same values in transistor 360 and in supplied follower transistors. That is, for example, the amount of change of base-to-emitter voltage $V_{be}$ for a given temperature change for supplied follower transistors is preferably substantially similar to the amount of change of base-to-emitter voltage $V_{be}$ for the same temperature change for transistor 360. However, the voltage values during such temperature changes may or may not be the same for supplied follower transistors as for transistor 360.

Figure 4:
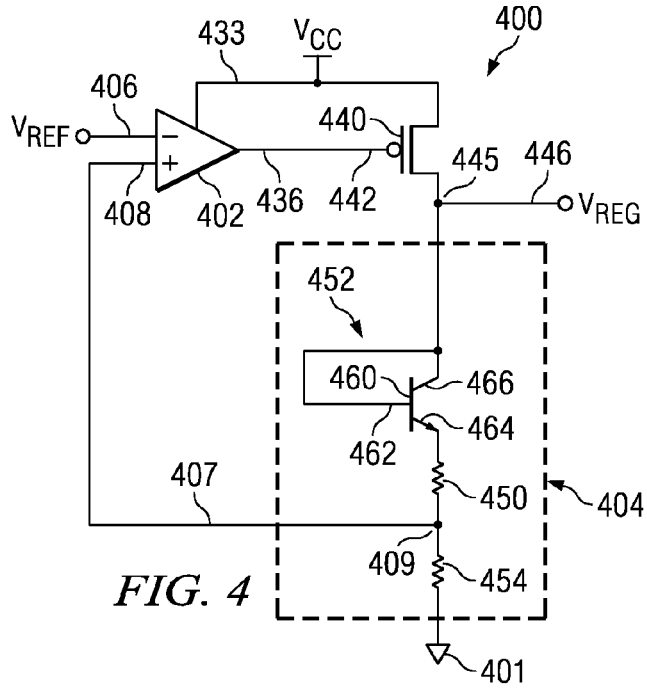
FIG. 4 is an electrical schematic diagram illustrating a first alternate embodiment of the temperature responsive unit of the present invention.

FIG. 4 is an electrical schematic diagram illustrating a first alternate embodiment of the temperature responsive unit of the present invention. In FIG. 4, a voltage regulator apparatus 400 includes a differential amplifier 402 and a temperature responsive unit 404. Differential amplifier 402 has a first input locus 406 and a second input locus 408. A reference voltage $V_{REF}$ is applied at first input locus 406. Second input locus 408 is coupled with temperature responsive unit 404 via feedback line 407.

An amplifier output locus 436 provides an output signal from differential amplifier 402 to a gate 442 of a PMOS transistor 440. Transistor 440 is coupled between a voltage supply line 433 providing a supply voltage $V_{CC}$ and temperature responsive unit 404. Temperature responsive unit 404 is coupled between transistor 440 and ground 401. A regulated signal output locus 446 is coupled with a connection locus 445 and presents a regulated output signal $V_{REG}$ from voltage regulator apparatus 400.

Temperature responsive unit 404 includes at least one resistive element coupled in series with a temperature responsive element. The temperature responsive element is designed to model the voltage-temperature response of supplied voltage follower buffers or transistors (e.g., transistors 140, 170; FIG. 2) in a stage of a differential signaling output device such as a differential signaling output device (FIG. 7) to which regulated output signal $V_{REG}$ is supplied. In the embodiment of temperature responsive unit 404 illustrated in FIG. 4, temperature responsive element 404 includes a temperature responsive element 452 coupled in series with a first resistive element 450 and a second resistive element 454 coupled in series between first resistive element 450 and ground 401. Feedback line 407 is coupled at a connection locus 409 intermediate resistors 450, 454.

Temperature responsive element 452 is preferably embodied in an NPN transistor 460 having a base 462, an emitter 464 and a collector 466. Collector 466 is coupled with transistor 440. Emitter 464 is coupled with resistive element 450. Base 462 is diode-coupled with collector 464. Preferably transistor 460 exhibits a similar voltage-temperature response as is exhibited by supplied voltage follower transistors (e.g., transistors 140, 170; FIG. 2) in supplied differential output stages (e.g., stages 12, 14; FIG. 2) to which regulated output signal $V_{REG}$ is supplied. It is desired that the voltage-temperature response of temperature responsive unit 404 closely track or mirror the voltage-temperature response exhibited by supplied stages (e.g., stages 12, 14; FIG. 2). However, choices of various components in voltage regulator apparatus 400 may require somewhat different voltage levels be experienced by transistor 460 than are experienced by supplied follower transistors (e.g., transistors 140, 170; FIG. 2). The term modeling is employed herein to indicate that the profile of voltage-temperature response for transistor 460 and for supplied follower transistors is preferably substantially similar, but the voltage values may not necessarily be the same values in transistor 460 and in supplied follower transistors. That is, for example, the amount of change of base-to-emitter voltage $V_{be}$ for a given temperature change for supplied follower transistors is preferably substantially similar to the amount of change of base-to-emitter voltage $V_{be}$ for the same temperature change for transistor 460. However, the voltage values during such temperature changes may or may not be the same for supplied follower transistors as for transistor 460.

Figure 5:
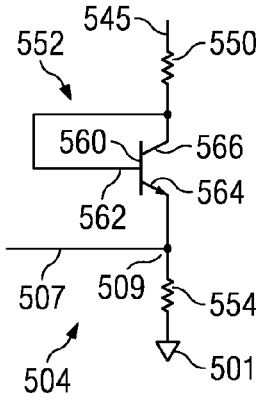
FIG. 5 is an electrical schematic diagram illustrating a second alternate embodiment of the temperature responsive unit of the present invention.

FIG. 5 is an electrical schematic diagram illustrating a second alternate embodiment of the temperature responsive unit of the present invention. In FIG. 5, a temperature responsive unit 504 is coupled between a connection locus 545 (similar to connection locus 445; FIG. 4) and ground 501. Temperature responsive unit 504 includes at least one resistive element coupled in series with a temperature responsive element. The temperature responsive element is designed to model the voltage-temperature response of supplied voltage follower buffers or transistors (e.g., transistors 140, 170; FIG. 2) in a stage of a differential signaling output device such as a differential signaling output device (FIG. 7) to which regulated output signal $V_{REG}$ is supplied. In the embodiment of temperature responsive unit 504 illustrated in FIG. 5, temperature responsive element 504 includes a first resistive element 550 coupled in series with a temperature responsive element 552 and a second resistive element 554 coupled in series between temperature responsive element 552 and ground 501. Feedback line 507 is coupled at a connection locus 509 intermediate temperature responsive element 552 and resistive element 554.

Temperature responsive element 552 is preferably embodied in an NPN transistor 560 having a base 562, an emitter 564 and a collector 566. Collector 566 is coupled with resistive element 550. Emitter 564 is coupled with resistive element 554. Base 562 is diode-coupled with collector 564. Preferably transistor 560 exhibits a similar voltage-temperature response as is exhibited by supplied voltage follower transistors (e.g., transistors 140, 170; FIG. 2) in supplied differential output stages (e.g., stages 12, 14; FIG. 2) to which regulated output signal $V_{REG}$ is supplied. It is desired that the voltage-temperature response of temperature responsive unit 504 closely track or mirror the voltage-temperature response exhibited by supplied stages (e.g., stages 12, 14; FIG. 2). However, choices of various components in a voltage regulator apparatus (not shown in FIG. 5) incorporating temperature responsive unit 504 may require somewhat different voltage levels be experienced by transistor 560 than are experienced by supplied follower transistors (e.g., transistors 140, 170; FIG. 2). The term modeling is employed herein to indicate that the profile of voltage-temperature response for transistor 560 and for supplied follower transistors is preferably substantially similar, but the voltage values may not necessarily be the same values in transistor 560 and in supplied follower transistors. That is, for example, the amount of change of base-to-emitter voltage $V_{be}$ for a given temperature change for supplied follower transistors is preferably substantially similar to the amount of change of base-to-emitter voltage $V_{be}$ for the same temperature change for transistor 560. However, the voltage values during such temperature changes may or may not be the same for supplied follower transistors as for transistor 560.

Figure 6:
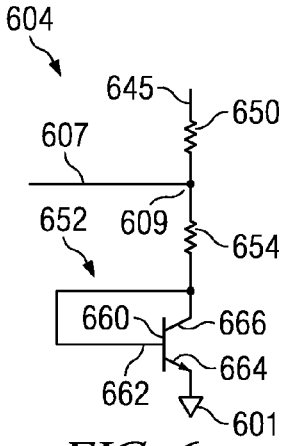
FIG. 6 is an electrical schematic diagram illustrating a third alternate embodiment of the temperature responsive unit of the present invention.

FIG. 6 is an electrical schematic diagram illustrating a third alternate embodiment of the temperature responsive unit of the present invention. In FIG. 6, a temperature responsive unit 604 is coupled between a connection locus 645 (similar to connection locus 445; FIG. 4) and ground 601. Temperature responsive unit 604 includes at least one resistive element coupled in series with a temperature responsive element. The temperature responsive element is designed to model the voltage-temperature response of supplied voltage follower buffers or transistors (e.g., transistors 140, 170; FIG. 2) in a stage of a differential signaling output device such as a differential signaling output device (FIG. 7) to which regulated output signal $V_{REG}$ is supplied. In the embodiment of temperature responsive unit 604 illustrated in FIG. 6, temperature responsive element 604 includes a first resistive element 650 coupled in series with a second resistive element 654 and a temperature responsive element 652 coupled in series between second resistive element 654 and ground 601. Feedback line 607 is coupled at a connection locus 609 intermediate resistive elements 650, 654.

Temperature responsive element 652 is preferably embodied in an NPN transistor 660 having a base 662, an emitter 664 and a collector 666. Collector 666 is coupled with resistive element 654. Emitter 664 is coupled with ground 601. Base 662 is diode-coupled with collector 664. Preferably transistor 660 exhibits a similar voltage-temperature response as is exhibited by supplied voltage follower transistors (e.g., transistors 140, 170; FIG. 2) in supplied differential output stages (e.g., stages 12, 14; FIG. 2) to which regulated output signal $V_{REG}$ is supplied. It is desired that the voltage-temperature response of temperature responsive unit 604 closely track or mirror the voltage-temperature response exhibited by supplied stages (e.g., stages 12, 14; FIG. 2). However, choices of various components in a voltage regulator apparatus (not shown in FIG. 6) incorporating temperature responsive unit 604 may require somewhat different voltage levels be experienced by transistor 660 than are experienced by supplied follower transistors (e.g., transistors 140, 170; FIG. 2). The term modeling is employed herein to indicate that the profile of voltage-temperature response for transistor 660 and for supplied follower transistors is preferably substantially similar, but the voltage values may not necessarily be the same values in transistor 660 and in supplied follower transistors. That is, for example, the amount of change of base-to-emitter voltage $V_{be}$ for a given temperature change for supplied follower transistors is preferably substantially similar to the amount of change of base-to-emitter voltage $V_{be}$ for the same temperature change for transistor 660. However, the voltage values during such temperature changes may or may not be the same for supplied follower transistors as for transistor 660.

Figure 7:
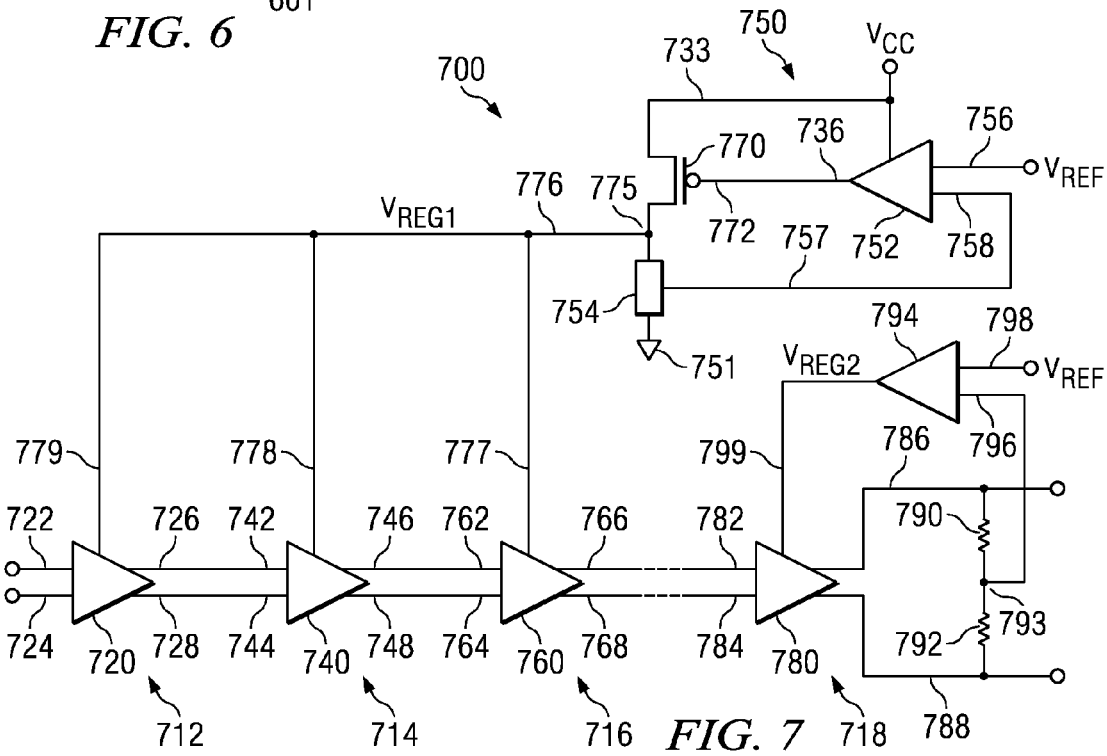
FIG. 7 is a simplified electrical schematic diagram illustrating a multi-stage differential signaling device employing the present invention.

FIG. 7 is a simplified electrical schematic diagram illustrating a multi-stage differential signaling device employing the present invention. In FIG. 7, a differential signaling output device 700 includes a first stage 712, a second stage 714, a third stage 716 and an nth stage 718. The indicator "n" is employed to signify that there can be any number of stages in security differential signaling output device 700. The inclusion of four stages 712, 714, 716, 718 in FIG. 7 is illustrative only.

First stage 712 includes a differential amplifier 720 receiving input signals at input loci 722, 724 and presenting output signals at output loci 726, 728. Second stage 714 includes a differential amplifier 740 receiving input signals at input loci 742, 744 and presenting output signals at output loci 746, 748. Input loci 742, 744 are coupled to receive signals from output loci 726, 728 of differential amplifier 720.

Third stage 716 includes a differential amplifier 760 receiving input signals at input loci 762, 764 and presenting output signals at output loci 766, 768. Input loci 762, 764 are coupled to receive signals from output loci 746, 748 of differential amplifier 740.

Nth stage 718 includes a differential amplifier 780 receiving input signals at input loci 782, 784 and presenting output signals at output loci 786, 788. Sampling resistors 790, 792 are coupled in series between output loci 786, 788. Sampling resistors 790, 792 are preferably substantially equal in value. An error amplifier 794 has input loci 796, 798 and an output line 799. First input locus 796 is coupled with a sampling locus 793. A reference voltage $V_{REF}$ is applied to second input locus 798. A regulating voltage $V_{REG2}$ is provided to differential amplifier 780 via output line 799. Input loci 782, 784 are coupled to receive signals from output loci from the next earlier adjacent differential amplifier in differential signaling output device 700, such as output loci 766, 768 of differential amplifier 760.

A voltage regulator apparatus 750 includes a differential amplifier 752 and a temperature responsive unit 754. Differential amplifier 752 has a first input locus 756 and a second input locus 758. A reference voltage $V_{REF}$ is applied at first input locus 756. Second input locus 758 is coupled with temperature responsive unit 754 via feedback line 757.

An amplifier output locus 736 provides an output signal from differential amplifier 752 to a gate 772 of a PMOS transistor 770. Transistor 770 is coupled between a voltage supply line 733 providing a supply voltage $V_{CC}$ to differential amplifier 752 and temperature responsive unit 754. Temperature responsive unit 754 is coupled between transistor 770 and ground 751. A regulated signal output locus 776 is coupled with a connection locus 775 and presents a regulated output signal $V_{REG1}$ from voltage regulator apparatus 750.

Temperature responsive unit 754 includes at least one resistive element coupled in series with a temperature responsive element. The temperature responsive element is designed to model the voltage-temperature response of supplied voltage follower buffers or transistors (e.g., transistors 140, 170; FIG. 2) in a stage 712, 714, 716, 718 of differential signaling output device 700 to which regulated output signal $V_{REG1}$ is supplied via lines 777, 778, 779 from regulated signal output locus 776.

Voltage regulator apparatus 750 provides regulated voltage $V_{REG1}$ to each stage 712, 714, 716 of differential signaling output device 700. In some applications, the common mode voltage of final nth stage 718 is at a level which requires using a dedicated error amplifier 794, as shown in FIG. 7. If common mode voltage requirements of nth stage 718 permit, voltage regulator apparatus 750 may be employed as the sole source of regulated voltage $V_{REG}$ for voltage regulator apparatus 750.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

We claim:

1. A multistage differential amplifier comprising:

a first amplifier stage, the first amplifier stage including:

a first differential pair of input NPN bipolar transistors with loads coupled to a supply voltage through a first common-mode PMOS transistor; and a first pair of emitter-follower output NPN bipolar transistors coupled to the first differential pair of input transistors;

a second amplifier stage, the second amplifier stage including:

a second differential pair of input transistors with loads coupled to the supply voltage through a second common-mode transistors; and a second pair of emitter-follower output transistors coupled to the second differential pair of input transistors, wherein the second differential pair of input transistors is coupled to the first pair of emitter-follower output transistors; and a voltage regulator coupled to control the first common-mode transistor, the voltage regulator including:

a differential amplifier with a first input from a reference voltage, a second input from a temperature responsive unit, and an output to a third transistor connected between a supply voltage and the temperature responsive unit; and a regulated voltage output node between the third transistor and the temperature responsive unit, wherein the temperature responsive unit includes in series a first resistor, a second resistor, and a diode-connected NPN bipolar transistor.

2. The amplifier of claim 1, wherein the voltage regulator is coupled to control the second common-mode transistor.

3. The amplifier of claim 2, further comprising a third amplifier stage, the third amplifier stage including:

a third differential pair of input transistors with loads coupled to the supply voltage through a third common-mode transistor; and a third pair of emitter-follower output transistors coupled to the third differential pair of input transistors, wherein the third differential pair of input transistors is coupled to the second pair of emitter-follower output transistors.

* * * * *